US008960444B2

(12) United States Patent
Ochi et al.

(10) Patent No.: US 8,960,444 B2
(45) Date of Patent: Feb. 24, 2015

(54) METHOD FOR SEPARATING ARSENIC MINERAL FROM COPPER-BEARING MATERIAL WITH HIGH ARSENIC GRADE

(75) Inventors: Daishi Ochi, Niihama (JP); Hideyuki Okamoto, Niihama (JP); Yoshihisa Takahashi, Niihama (JP); Yuji Aoki, Niihama (JP); Hiroichi Miyashita, Niihama (JP); Shigeto Kuroiwa, Niihama (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 1092 days.

(21) Appl. No.: 12/737,333

(22) PCT Filed: Oct. 27, 2009

(86) PCT No.: PCT/JP2009/068391

§ 371 (c)(1),
(2), (4) Date: Dec. 30, 2010

(87) PCT Pub. No.: WO2010/050462

PCT Pub. Date: May 6, 2010

(65) Prior Publication Data

US 2011/0094942 A1 Apr. 28, 2011

(30) Foreign Application Priority Data

Oct. 29, 2008 (JP) ..... 2008-277908
Apr. 13, 2009 (JP) ..... 2009-096657

(51) Int. Cl.

| | |
|---|---|
| ***B03D 1/002*** | (2006.01) |
| ***B03D 1/02*** | (2006.01) |
| ***B03D 1/06*** | (2006.01) |
| ***C22B 15/00*** | (2006.01) |
| ***B03D 1/012*** | (2006.01) |
| ***C22B 30/04*** | (2006.01) |

(52) U.S. Cl.

CPC ..... *C22B 15/0008* (2013.01); *B03D 1/002* (2013.01); *B03D 1/012* (2013.01); *B03D 1/02* (2013.01); *C22B 30/04* (2013.01); *B03D 2201/06* (2013.01); *B03D 2203/02* (2013.01)

USPC ..... 209/167

(58) Field of Classification Search

CPC ..... B03D 1/02; B03D 1/06
USPC ..... 209/166, 167
See application file for complete search history.

(56) References Cited

U.S. PATENT DOCUMENTS 5,171,428 A 12/1992 Beattie et al.
7,004,326 B1 * 2/2006 Dai et al. ..... 209/166

FOREIGN PATENT DOCUMENTS

JP 2006-239553 A 9/2006

OTHER PUBLICATIONS

D. Fornasiero et al., "Separation of enargite and tennantite from non-arsenic copper sulfide minerals by selective oxidation or dissolution," Int. J. Miner. Process. 61, 2001, pp. 109-119.
International Search Report dated Jan. 12, 2010, issued for PCT/JP2009/068391.

* cited by examiner

*Primary Examiner* — Thomas M Lithgow
(74) *Attorney, Agent, or Firm* — Edwards Wildman Palmer LLP; James E. Armstrong, IV

(57) ABSTRACT

There is provided a method for separating an arsenic mineral from a copper-bearing material containing arsenic, such as a copper ore or a copper concentrate, to obtain a copper concentrate with low arsenic grade.
The method for separating an arsenic mineral from a copper-bearing material by flotation includes adding a flotation agent containing a depressant, a frother, and a collector to a slurry composed of a copper-bearing material containing arsenic, and blowing air into the slurry to float a copper concentrate, wherein the depressant is sodium thiosulfate. The sodium thiosulfate is preferably added in an amount of 10 kg or more and 200 kg or less in terms of sodium thiosulfate pentahydrate per ton of copper-bearing material to be subjected to flotation. Further, the oxidation-reduction potential of the slurry to be subjected to flotation, as measured against a silver/silver chloride reference electrode, is preferably −10 mV or more and 50 mV or less.

9 Claims, 3 Drawing Sheets

METHOD FOR SEPARATING ARSENIC MINERAL FROM COPPER-BEARING MATERIAL WITH HIGH ARSENIC GRADE

TECHNICAL FIELD

The present invention relates to a beneficiation method for separating an arsenic mineral from a copper-bearing material containing arsenic to obtain a copper concentrate with low arsenic grade.

BACKGROUND ART

In the field of copper refining, various methods have been proposed for recovering copper from an object to be treated containing copper (hereinafter, referred to as a "copper-bearing material") such as a copper ore or a copper concentrate. For example, in order to recover copper from a copper sulfide ore which is one form of a copper-bearing material, the copper sulfide ore is generally treated by the following steps.

(1) Flotation Step

In the flotation step, a copper ore obtained from a mine is ground and then mixed with water to prepare a slurry, and the slurry is subjected to flotation. The flotation is performed by adding a flotation agent containing a depressant, a frother, and a collector to the slurry and by blowing air into the slurry. As a result, a copper-bearing mineral is separated as a float fraction and gangue is separated as a sink fraction. In this way, a copper concentrate with a copper grade of about 30% is obtained. The obtained copper concentrate is sent to the next pyrometallurgical smelting step.

(2) Pyrometallurgical Smelting Step

In the pyrometallurgical smelting step, the copper concentrate obtained in the above flotation step is smelted using a furnace such as a flash furnace, and then refined in a converter and an anode furnace to obtain blister copper with a copper grade of about 99%. The blister copper is cast into anodes and then sent to the next electrolysis step. This pyrometallurgical smelting process distributes arsenic contained in the copper concentrate among slag, dust, and the blister copper. The slag is granulated with water and used as, for example, a land-fill material. The dust is returned to the furnace. Sulfur contained in the copper concentrate is separated as sulfur dioxide gas and used as a raw material of sulfuric acid.

(3) Electrolysis Step

In the electrolysis step, the anodes are placed in an electrolytic cell filled with a sulfuric acidic solution (electrolytic solution) and electric current is passed between the anodes and cathodes to perform electrolytic refining. As a result, copper is dissolved from the anodes and deposited on the cathodes as electrolytic copper which is a product with a purity of 99.99%. Along with the electrolysis step, the arsenic distributed to the anodes is eluted into the electrolytic solution. The eluted arsenic is recovered as decopperized slime by decopperizing electrolysis. The decopperized slime is used as an intermediate material or returned to the furnace.

The arsenic distributed to the slag in the pyrometallurgical smelting step is fixed in a stable form in the slag. On the other hand, the arsenic distributed to the dust and the decopperized slime is in an unstable form, and therefore it is not preferable that the dust and the decopperized slime are directly discharged to the outside of the system and disposed of. For this reason, the dust and the decopperized slime are returned to the furnace or further treated through an additional process. In this way, most of the arsenic contained in the copper concentrate is finally distributed to slag and fixed in a stable form in the slag.

Recently, the situation with regard to raw materials of copper has been changed. More specifically, the impurity grade, especially arsenic grade of copper ores is increasing year after year, and therefore the arsenic grade of copper concentrates obtained from the copper ores is also increasing gradually. For example, the arsenic grade of copper concentrates is conventionally about 0.1 to 0.2%, but in recent years, it is not unusual that the arsenic grade of copper concentrates exceeds 1%. Due to such an increase in the arsenic content of copper concentrates, there is a case where existing slag treatment equipment cannot cope with an increase in the amount of arsenic fixed in slag in spite of the fact that the amount of copper concentrate treated is the same as before. Such a problem can be solved by, for example, providing new slag treatment equipment or increasing the capacity of the existing slag treatment equipment, but this requires a significant investment and therefore increases cost.

If the arsenic grade of a copper concentrate obtained from a copper ore with high arsenic grade can be reduced to, for example, the same level as before by separating and removing arsenic from the copper ore with high arsenic grade, the load of arsenic to be treated could be kept at the same level as before, which eliminates the necessity of making such a capital investment.

In this regard, Patent Document 1 proposes a method for separating arsenopyrite contained in iron pyrite by flotation. According to this method, a sulfuric acid-based depressant containing hydrogen sulfite ions, such as sodium hydrogen sulfite, is added to iron pyrite to prepare a slurry, and then the slurry is subjected to flotation under conditions where the pH of the slurry is maintained at 8 or less and the temperature of the slurry is 30° C. or higher to separate arsenopyrite from the iron pyrite.

However, it is difficult to directly apply this method to the separation of arsenic from a copper ore or copper concentrate. This is because, in most cases, arsenic is present as an arsenic mineral such as tennantite ($(CuFe)_{12}As_4S_{13}$) or enargite ($Cu_3AsS_4$) in, for example, a copper concentrate mainly containing chalcopyrite or bornite and these arsenic minerals have floatability similar to that of chalcopyrite or bornite, which makes it difficult to separate copper and arsenic from each other by flotation.

Further, Patent Document 2 proposes a method for separating an arsenic mineral contained in an arsenic-bearing copper concentrate. According to this method, a copper concentrate is thermally treated at 90 to 120° C., and then potassium hexacyanoferrate (II) (yellow prussiate of potash: $K_4[Fe(CN)_6]$) as a depressant for depressing copper is added in an amount of 10 to 15 kg per ton of copper concentrate so that an arsenic mineral is separated as a float fraction and chalcopyrite or bornite is separated as a sink fraction.

This method oxidizes a surface of the copper mineral in a copper concentrate by heating so as to form inactive oxide film on the surface, which is believed to cause a difference in surface conditions between the copper-mineral and the arsenic mineral from the viewpoint of surface chemistry or crystal chemistry. However, the practical use of this method requires equipment and energy for heating a large amount of copper concentrate, which leads to an increase in cost.

Further, Non-Patent Document 1 proposes a flotation method in which a slurry containing copper minerals is treated with hydrogen peroxide and then sodium nitrate is added to adjust the pH of the slurry to 5. Non-Patent Document 1 also proposes a flotation method in which hydrogen peroxide and EDTA are added to copper minerals, and then potassium hydroxide is added to adjust pH to 11. However, these two methods use deleterious substances and therefore have safety problems associated with handling of these deleterious substances as well as cost problems.

As has been described above, it is difficult for any of these conventional methods to efficiently separate an arsenic mineral from a copper-bearing material by flotation.

PRIOR-ART DOCUMENTS

Patent Documents

Patent Document 1: U.S. Pat. No. 5,171,428

Patent Document 2: Japanese Patent Application Laid-Open No. 2006-239553

Non-Patent Document

Non-Patent Document 1: D. Fornasiero, D. Fullston, C. Li and J. Ralston: Mineral Processing, 61 (2001), 109-119

DISCLOSURE OF THE INVENTION

Problems to be Solved by the Invention

In view of the above problems of the conventional art, it is an object of the present invention to provide a beneficiation method for efficiently separating an arsenic mineral from a copper-bearing material containing arsenic.

Means for Solving the Problems

In order to achieve the above object, the present invention provides a method for separating an arsenic mineral from a copper-bearing material by flotation, the method including adding a flotation agent containing a depressant, a frother, and a collector to a slurry composed of a copper-bearing material containing arsenic, and blowing air into the slurry to float a copper concentrate, wherein the depressant is sodium thiosulfate.

In the separation method according to the present invention, the sodium thiosulfate is preferably added in an amount of 10 kg or more and 200 kg or less in terms of sodium thiosulfate pentahydrate per ton of copper-bearing material to be subjected to the flotation. Further, in the separation method according to the present invention, the oxidation-reduction potential of the slurry to be subjected to the flotation, as measured against a silver/silver chloride reference electrode, is preferably adjusted to −10 mV or more and 50 mV or less. Further, in the separation method according to the present invention, the copper-bearing material may be either a copper ore or a copper concentrate.

Effects of the Invention

According to the present invention, it is possible to separate an arsenic mineral from a copper-bearing material with high arsenic grade and to efficiently obtain a copper concentrate with low arsenic grade without using special equipment and chemicals. The use of the thus obtained copper concentrate with low arsenic grade as a raw material of copper smelting makes it possible to reduce the adverse effect of arsenic on surrounding environment during smelting process as well as to suppress an increase in investment associated with an increase in the load of arsenic to be treated. Further, the present invention enables collective recovery of arsenic minerals as an arsenic concentrate, which makes it possible to improve the production efficiency of metal arsenic or arsenic compounds.

BEST MODE FOR CARRYING OUT THE INVENTION

Figure 1:
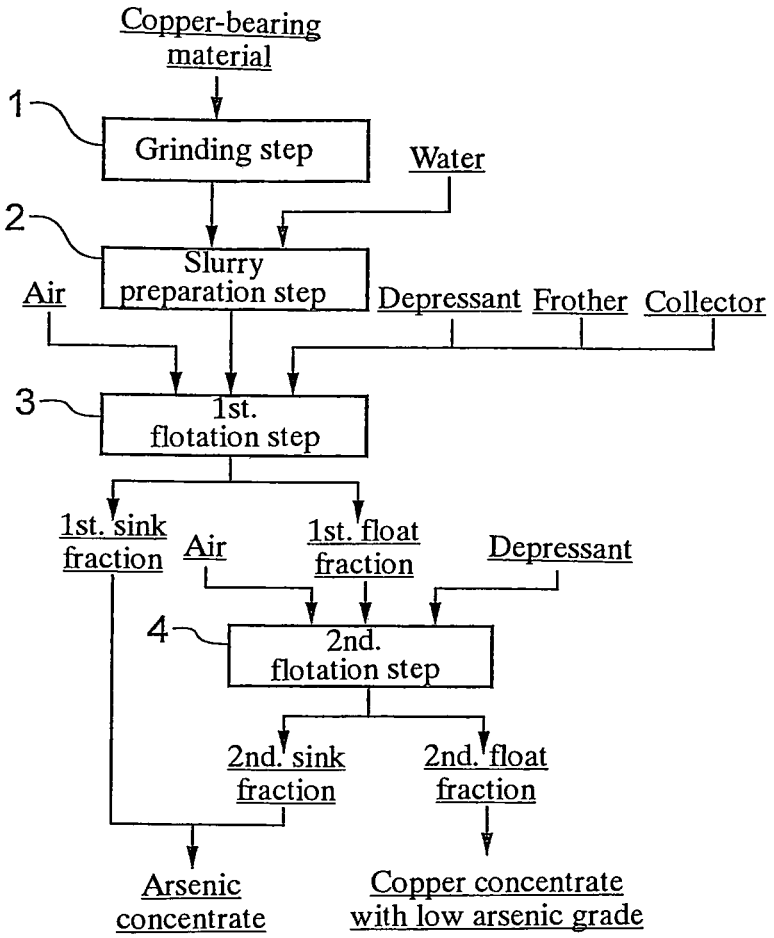
FIG. 1 is a schematic flow diagram of a beneficiation method used in Examples 1 and 2 according to the present invention.

The present invention is directed to a treatment of a copper-bearing material with high arsenic grade, where arsenic grades of the copper-bearing material or kinds of arsenic mineral contained in the copper-bearing material are not particularly limited. However, the arsenic mineral needs to be present as free particles in order to efficiently perform flotation, and therefore pretreatment such as grinding is preferably performed on the copper-bearing material so that most of the arsenic mineral are separated to form free particles. In a case where it is difficult to achieve satisfactory separation between an arsenic mineral and a copper mineral contained in a copper-bearing material due to tight binding between them, the copper-bearing material should be ground by, for example, a wet ball mill before the copper-bearing material is treated according to the present invention.

Hereinbelow, with reference to a case where the copper-bearing material is a copper ore, a method will be described in detail for separating an arsenic mineral together with gangue from a copper-bearing material with high arsenic grade so as to recover a copper concentrate with low arsenic grade. However, the present invention is not limited thereto, and the copper-bearing material may be a copper concentrate. That is, the present invention can also be applied to a case where an arsenic mineral is separated from a copper concentrate with high arsenic grade obtained by a conventional flotation method generally used to recover a copper concentrate with low arsenic grade. In this case, the copper grade of the copper concentrate with high arsenic grade to be used as a raw material is not particularly limited.

As described above, in a case where the copper-bearing material is a copper ore with high arsenic grade, the copper ore is subjected to grinding as pretreatment and then mixed with water to prepare a slurry. Then, the slurry is mixed with a flotation agent containing a frother, a collector, and a depressant and then subjected to flotation. At this time, sodium thiosulfate is used as the depressant. This makes it possible to float and separate a copper concentrate with low arsenic grade mainly containing chalcopyrite or bornite while allowing an arsenic mineral contained in the copper-bearing material with high arsenic grade to sink as an arsenic concentrate together with gangue.

The form of sodium thiosulfate added as the depressant is not particularly limited, and may be powder or solution. The amount of sodium thiosulfate added is preferably 10 kg or more and 200 kg or less in terms of sodium thiosulfate pentahydrate per ton of copper-bearing material to be subjected to flotation. If the amount of sodium thiosulfate added is less than 10 kg/t, the effect of sodium thiosulfate on the separation of arsenic minerals (hereinafter, simply referred to as "separation effect") is less likely to be exhibited. On the other hand, if the amount of sodium thiosulfate added exceeds 200 kg/t, the separation effect tends to be reduced. It is to be noted that when the amount of sodium thiosulfate added is less than 50 kg/t, the separation effect is enhanced as the amount of sodium thiosulfate added is increased, but even when the amount of sodium thiosulfate added exceeds 130 kg/t, the separation effect is not so enhanced. Therefore, the amount of sodium thiosulfate added is more preferably in the range of 50 kg/t or more and 130 kg/t or less.

The addition of sodium thiosulfate to the slurry changes the oxidation-reduction potential of the slurry. If the oxidation-reduction potential of the slurry, as measured against a silver/silver chloride reference electrode, exceeds 50 mV, the separation effect is not enhanced in proportion to an increase in the oxidation-reduction potential of the slurry. On the other hand, if the oxidation-reduction potential of the slurry, as measured against a silver/silver chloride reference electrode, is less than −10 mV, the separation effect tends to be reduced. Therefore, the oxidation-reduction potential of the slurry to be subjected to flotation, as measured against a silver/silver chloride reference electrode, is preferably adjusted to −10 mV or more and 50 mV or less by adding sodium thiosulfate to the slurry.

As described above, addition of sodium thiosulfate depresses an arsenic mineral, which makes it possible to efficiently separate the arsenic mineral from a floating copper concentrate such as chalcopyrite. However, the mechanism thereof is not apparent and there are no reports that may serve as useful references either.

As for the frother and the collector contained in the flotation agent, X-95 and AP208 manufactured by Cytec Industries Inc. were used respectively in Examples which will be described later. However, the frother and the collector are not limited thereto, and other conventional ones may be used. The amounts of the frother and the collector added may be determined by previously performing a preliminary test using a small amount of sample or by selecting appropriate amounts during operation so that satisfactory separation can be achieved.

A flotation machine to be used in the present invention is not particularly limited either, and a commercially-available mechanical agitation-type flotation machine or column-type flotation machine can be used. The amount of time for flotation is preferably determined in the same manner as in the above-described case of determining the amounts of the frother and the collector added, that is, by performing a preliminary test or by appropriately adjusting a flotation time during operation, because the appropriate amount of the flotation time varies depending on the arsenic mineral content of a copper ore or copper concentrate with high arsenic grade to be treated or a target degree of separation.

According to the above-described method, an arsenic mineral contained in a copper-bearing material with high arsenic grade is separated as a sink fraction and a copper concentrate with low arsenic grade is separated as a float fraction. In this way, a copper concentrate with low arsenic grade and an arsenic concentrate can be obtained by flotation, and therefore even when the arsenic content of a copper-bearing material to be treated is increased, electrolytic copper as a product can be obtained in the same manner as before through pyrometallurgical smelting of the copper-bearing material without the necessity of making a significant investment in, for example, increasing the capacity of equipment for removing and recovering arsenic such as slag treatment equipment or decopperizing electrolysis equipment. The arsenic concentrate can be further treated through an additional process to recover arsenic and to recover copper distributed to the arsenic concentrate. The recovered arsenic can be used as a raw material of metal arsenic or arsenic compounds.

EXAMPLES

The present invention will be described in more detail with reference to the following Examples and Comparative Examples. However, the present invention is not limited to these Examples at all. It is to be noted that in the following Examples and Comparative Examples, chemical analytical values were determined by ICP emission spectrometry and mineral compositions were determined by microscope observation. The values of oxidation-reduction potential were measured against a silver/silver chloride reference electrode.

Example 1

In Example 1, a copper concentrate from Peru was used as a copper-bearing material. The chemical analytical values and mineral composition of the copper concentrate are shown in Table 1.

TABLE 1

| Chemical analytical value (wt %) | | Mineral composition (wt %) | | |
|---|---|---|---|---|
| Cu | As | Chalcopyrite | Chalcocite | Tennantite |
| 22.3 | 1.06 | 57.0 | 0.2 | 6.6 |

The copper concentrate from Peru shown in the above Table 1 was subjected to flotation in accordance with the flow chart shown in FIG. 1 to obtain a copper concentrate with low arsenic grade and an arsenic concentrate. More specifically, the copper concentrate from Peru was ground by a ball mill so that a 80% passing particle size of 15 μm was achieved (grinding step 1). Then, 25 g of the ground copper concentrate was mixed with 400 mL of water and stirred for 3 minutes to prepare a slurry (slurry preparation step 2). The slurry was placed in an Agitair laboratory flotation machine having a cell volume of 0.5 L.

Then, sodium thiosulfate was added as a depressant for depressing an arsenic mineral in an amount of 10 kg in terms of sodium thiosulfate pentahydrate per ton of copper concentrate to be subjected to flotation. Then, X-95 (trade name) manufactured by Cytec Industries Inc. (US) was added as a frother in an amount of 600 g per ton of copper concentrate to be subjected to flotation, that is, in an amount of 0.015 g. Finally, AP208 (trade name) manufactured by Cytec Industries Inc. (US) was added as a collector in an amount of 250 g per ton of copper concentrate to be subjected to flotation, that is, in an amount of 0.0063 g, and the slurry was stirred for 10 minutes.

Then, flotation was performed by blowing air into the slurry at a flow rate of 2 L/min for 8 minutes under stirring to separate the slurry into a first float fraction and a first sink fraction (first flotation step 3). The first float fraction obtained in the form of slurry was again placed in the same flotation machine used in the above step. Then, sodium thiosulfate was added to the first float fraction in the form of slurry in an amount of 2 kg in terms of sodium thiosulfate pentahydrate per ton of copper concentrate, and the first float fraction was stirred for 3 minutes. Then, flotation was performed by blowing air into the first float fraction at a flow rate of 2 L/min for 5 minutes to obtain a second float fraction and a second sink fraction (second flotation step 4).

It is to be noted that even when the flotation was repeated three times or more, the result of separation between a float fraction and a sink fraction was not so improved. Therefore, the first sink fraction obtained in the first flotation step and the second sink fraction obtained in the second flotation step were mixed together to obtain an arsenic concentrate, and the second float fraction was defined as a copper concentrate with low arsenic grade. These copper concentrate with low arsenic grade and arsenic concentrate were defined as Sample 1.

Samples 2 to 5 were prepared in the following manner for comparison purposes. More specifically, a copper concentrate with low arsenic grade and an arsenic concentrate of Sample 2 were obtained by performing flotation in the same manner as in the case of obtaining Sample 1 except that addition of sodium thiosulfate as a depressant after repulping was omitted.

A copper concentrate with low arsenic grade and an arsenic concentrate of Sample 3 were obtained by performing flotation in the same manner as in the case of obtaining Sample 1 except that sodium borohydride was added as a depressant instead of sodium thiosulfate in a total amount of 17 kg per ton of copper concentrate to be subjected to flotation, that is, in an amount of 0.425 g. It is to be noted that the amount of sodium borohydride added in the first flotation step was 15 kg/t and the remaining 2 kg/t of sodium borohydride was added in the second flotation step.

A copper concentrate with low arsenic grade and an arsenic concentrate of Sample 4 were obtained by performing flotation in the same manner as in the case of obtaining Sample 1 except that potassium hexacyanoferrate (II) (yellow prussiate of potash) was added as a depressant instead of sodium thiosulfate in a total amount of 16 kg per ton of copper concentrate to be subjected to flotation, that is, in an amount of 0.4 g.

Finally, a copper concentrate with low arsenic grade and an arsenic concentrate of Sample 5 were obtained by performing flotation in the same manner as in the case of obtaining Sample 1 except that hydrazine having high reducing capacity was added as a depressant instead of sodium thiosulfate in a total amount of 16 kg in terms of hydrazine monohydrate per ton of copper concentrate to be subjected to flotation, that is, in an amount of 0.4 g.

The copper grade and arsenic grade of the copper concentrate with low arsenic grade and those of the arsenic concentrate were determined for each of Samples 1 to 5. Further, the ratio of distribution of copper to the copper concentrate with low arsenic grade and that to the arsenic concentrate were determined for each of Samples 1 to 5. Similarly, the ratio of distribution of arsenic to the copper concentrate with low arsenic grade and that to the arsenic concentrate were determined for each of Samples 1 to 5. Then, the degree of separation was obtained for each of Samples 1 to 5. The results are shown in the following Table 2.

TABLE 2

| Sample | Depressant | Amount of depressant added (kg/t) | Ratio of distribution of Cu (%) | | Ratio of distribution of As (%) | | Degree of separation |
|---|---|---|---|---|---|---|---|
| | | | Cu concentrate with low As grade | As concentrate | Cu concentrate with low As grade | AS concentrate | |
| 1 | A | 12 | 83 | 17 | 38 | 62 | 8.0 |
| 2* | Not added | — | 81 | 19 | 49 | 51 | 4.4 |
| 3* | B | 17 | 76 | 24 | 50 | 50 | 3.2 |
| 4* | C | 16 | 90 | 10 | 72 | 28 | 3.5 |
| 5* | D | 16 | 82 | 18 | 56 | 44 | 3.6 |

(Note)
The depressants A, B, C, and D refer to sodium thiosulfate, sodium borohydride, potassium hexacyanoferrate (II) (yellow prussiate of potash), and hydrazine, respectively. In Table 2, samples of Comparative Examples are marked with the symbol "*".

Here, the degree of separation is an indicator showing an extent of separation between copper and arsenic, and is determined by the following formula 1.

Degree of separation=(ratio of distribution of copper to copper concentrate with low arsenic grade/ratio of distribution of copper to arsenic concentrate)/(ratio of distribution of arsenic to copper concentrate with low arsenic grade/ratio of distribution of arsenic to arsenic concentrate) [Formula 1]

As can be seen from the above Formula 1, a higher degree of separation is achieved by an increase of a ratio of distribution of copper to the copper concentrate with low arsenic grade (float fraction) and by a decrease of a ratio of distribution of arsenic to the copper concentrate with low arsenic grade. That is, a higher degree of separation indicates that the separation has been performed with a more preferable result that fulfills the purpose of the present invention.

As can be seen from the above Table 2, in the case of Sample 1 obtained by adding sodium thiosulfate in a total amount of 12 kg/t, 83% of copper contained in the copper concentrate subjected to flotation was distributed to the copper concentrate with low arsenic grade, that is, the ratio of distribution of copper to the arsenic concentrate was 17%. On the other hand, 62% of arsenic contained in the copper concentrate subjected to flotation was distributed to the arsenic concentrate, that is, the ratio of distribution of arsenic to the copper concentrate with low arsenic grade was as low as 38%. As a result, a degree of separation of 8.0 was achieved. On the other hand, in the cases of Samples 2 to 5 as Comparative Examples, the values of the degree of separation were 4.4, 3.2, 3.5, and 3.6, respectively, which were lower than that of Sample 1. This indicates that separation between copper and arsenic was not satisfactorily performed in these Comparative Examples.

It is to be noted that, as shown in Table 1, the arsenic grade of the copper concentrate used in Example 1 is 1.06% which is about five times higher than that of the conventionally treated copper concentrate, i.e., 0.2%. For the purpose of reference, this copper concentrate used in Example 1 was directly treated through a pyrometallurgical smelting process without performing any treatment to decrease its arsenic grade. Since the maximum capability of this pyrometallurgical smelting process in terms of arsenic grade in a copper concentrate was 0.4%, its daily throughput was reduced to about 50% of its normal daily throughput treating a conventional copper concentrate with low arsenic grade. In contrast, the arsenic grade of the copper concentrate obtained in Example 1 was as low as 0.38%, which made it possible to treat the same amount of copper concentrate as before, thereby reducing investment cost required for increasing the capacity of equipment.

Example 2

Copper concentrates with low arsenic grade and arsenic concentrates of Samples 6 to 17 were obtained in the same manner as in the case of obtaining Sample 1 except that the total amount of sodium thiosulfate added per ton of copper concentrate to be subjected to flotation was changed to a value within the range of 25 to 271 kg. It is to be noted that in all the cases of Samples 6 to 17, the amount of sodium thiosulfate added in the second flotation step 4 was 2 kg/t. The copper grade and arsenic grade of the copper concentrate with low arsenic grade and those of the arsenic concentrate were determined for each of Samples 6 to 17. Further, the ratio of distribution of copper to the copper concentrate with low arsenic grade and that to the arsenic concentrate were determined for each of Samples 6 to 17. Similarly, the ratio of distribution of arsenic to the copper concentrate with low arsenic grade and that to the arsenic concentrate were determined for each of Samples 6 to 17. Then, the degree of separation was obtained for each of Samples 6 to 17. The results are shown in the following Table 3.

TABLE 3

| Sample | Depressant | Amount of depressant added (kg/t) | Ratio of distribution of Cu (%) | | Ratio of distribution of As (%) | | Degree of separation |
|---|---|---|---|---|---|---|---|
| | | | Cu concentrate with low As grade | As concentrate | Cu concentrate with low As grade | As concentrate | |
| 6 | A | 25 | 88 | 12 | 38 | 62 | 12.0 |
| 7 | A | 49 | 91 | 9 | 41 | 59 | 14.6 |
| 8 | A | 56 | 78 | 22 | 22 | 78 | 12.6 |
| 9 | A | 60 | 90 | 10 | 43 | 57 | 11.9 |
| 10 | A | 75 | 83 | 17 | 25 | 75 | 14.6 |
| 11 | A | 104 | 84 | 16 | 25 | 75 | 15.8 |
| 12 | A | 136 | 90 | 10 | 37 | 63 | 15.3 |
| 13 | A | 178 | 79 | 21 | 21 | 79 | 14.2 |
| 14 | A | 182 | 80 | 20 | 24 | 76 | 12.7 |
| 15 | A | 199 | 78 | 22 | 22 | 78 | 12.6 |
| 16 | A | 217 | 83 | 17 | 27 | 73 | 13.2 |
| 17 | A | 271 | 76 | 24 | 20 | 80 | 12.7 |

(Note)
The depressant A refers to sodium thiosulfate.

Figure 2:
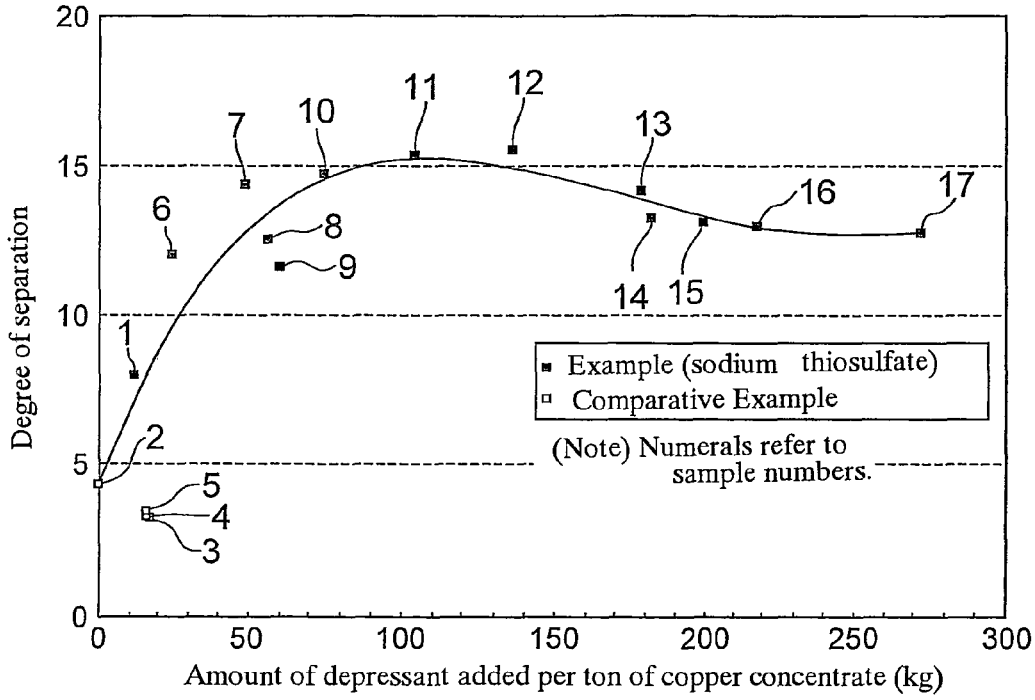
FIG. 2 is a graph showing the relationship between the amount of a depressant added and the degree of separation determined from the results of Examples 1 and 2.

As can be seen from Table 3, in all the cases of Samples 6 to 17, the degree of separation was as high as about 12 or higher. In order to determine the relationship between the amount of the depressant added and the degree of separation, the results of Samples 1 to 17 were plotted to obtain a graph whose horizontal axis represents the amount of the depressant added and vertical axis represents the degree of separation. The thus obtained graph is shown in FIG. 2. As can be seen from FIG. 2, the amount of the depressant added per ton of copper concentrate to be subjected to flotation is preferably 10 kg or more and 200 kg or less in terms of sodium thiosulfate pentahydrate. Particularly, when the amount of the depressant added is less than 50 kg/t, the separation effect is enhanced as the amount of the depressant added is increased. On the other hand, even when the amount of the depressant added exceeds 130 kg/t, the separation effect is not so enhanced. From the result, it can be said that the amount of the depressant added is more preferably 50 kg/t or more and 130 kg/t or less.

Example 3

A copper concentrate from Peru was used as a copper-bearing material. The chemical analytical values and mineral composition of the copper concentrate are shown in the following Table 4.

TABLE 4

| Chemical analytical value (wt %) | | Mineral composition (wt %) | | |
|---|---|---|---|---|
| Cu | As | Chalcopyrite | Chalcocite | Tennantite |
| 26.6 | 0.15 | 79.1 | 2.1 | 1.3 |

Figure 3:
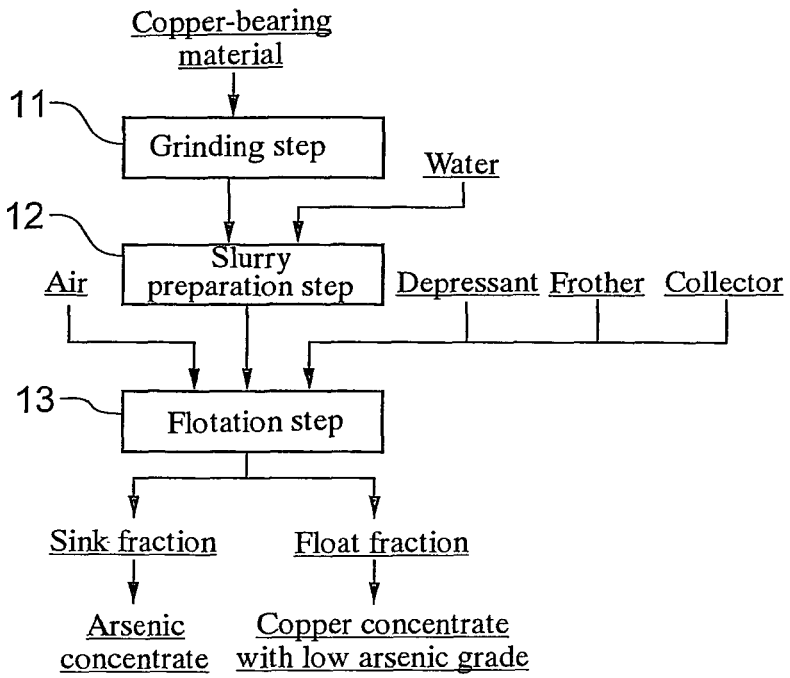
FIG. 3 is a schematic flow diagram of a beneficiation method used in Examples 3 to 6 according to the present invention.

The copper concentrate from Peru shown in the above Table 4 was subjected to flotation in accordance with the flow chart shown in FIG. 3 to obtain a copper concentrate with low arsenic grade and an arsenic concentrate. More specifically, the copper concentrate from Peru shown in the above Table 4 was ground by a ball mill so that a 80% passing particle size of 15 μm was achieved (grinding step 11). Then, 100 g of the ground copper concentrate was sampled, mixed with 400 mL of water, and then stirred for 3 minutes to prepare a slurry (slurry preparation step 12). The slurry was placed in an Agitair laboratory flotation machine having a cell volume of 0.5 L.

Then, sodium thiosulfate was added as a depressant for depressing arsenic minerals in an amount of 104 kg in terms of sodium thiosulfate pentahydrate per ton of copper concentrate, that is, in an amount of 10.4 g to adjust the oxidation-reduction potential of the slurry to 15 mV. Then, X-95 (trade name) manufactured by Cytec Industries Inc. (US) was added as a frother in an amount of 20 g per ton of copper concentrate, that is, in an amount of 0.002 g.

Finally, AP208 (trade name) manufactured by Cytec Industries Inc. (US) was added as a collector in an amount of 75 g per ton of copper concentrate, that is, in an amount of 0.0075 g, and then the slurry was stirred for 10 minutes. Then, flotation was performed by blowing air into the slurry at a flow rate of 2 L/min for 8 minutes under stirring to separate the slurry into a float fraction and a sink fraction (flotation step 13). In this way, a copper concentrate with low arsenic grade (float fraction) and an arsenic concentrate (sink fraction) of Sample 18 were obtained.

Example 4

Copper concentrates with low arsenic grade and arsenic concentrates of Samples 19 to 23 were obtained in the same manner as in Example 3 except that the amount of sodium thiosulfate added as a depressant after repulping was changed so that the oxidation-reduction potential of the slurry was adjusted to a value within the range of −8 to 49 mV. For comparison purposes, copper concentrates with low arsenic grade and arsenic concentrates of Samples 24 and 25 were obtained in the same manner as in Example 3 except that addition of sodium thiosulfate as a depressant after repulping was omitted.

Example 5

Copper concentrates with low arsenic grade and arsenic concentrates of Samples 26 to 30 were obtained in the same manner as in Example 3 except that the amount of sodium thiosulfate added as a depressant after repulping was changed so that the oxidation-reduction potential of the slurry was adjusted to a value within the range of 59 to 158 mV.

Example 6

A copper concentrate with low arsenic grade and an arsenic concentrate of Sample 31 were obtained in the same manner as in Example 3 except that the amount of sodium thiosulfate added as a depressant after repulping was changed so that the oxidation-reduction potential of the slurry was adjusted to −40 mV.

Figure 4:
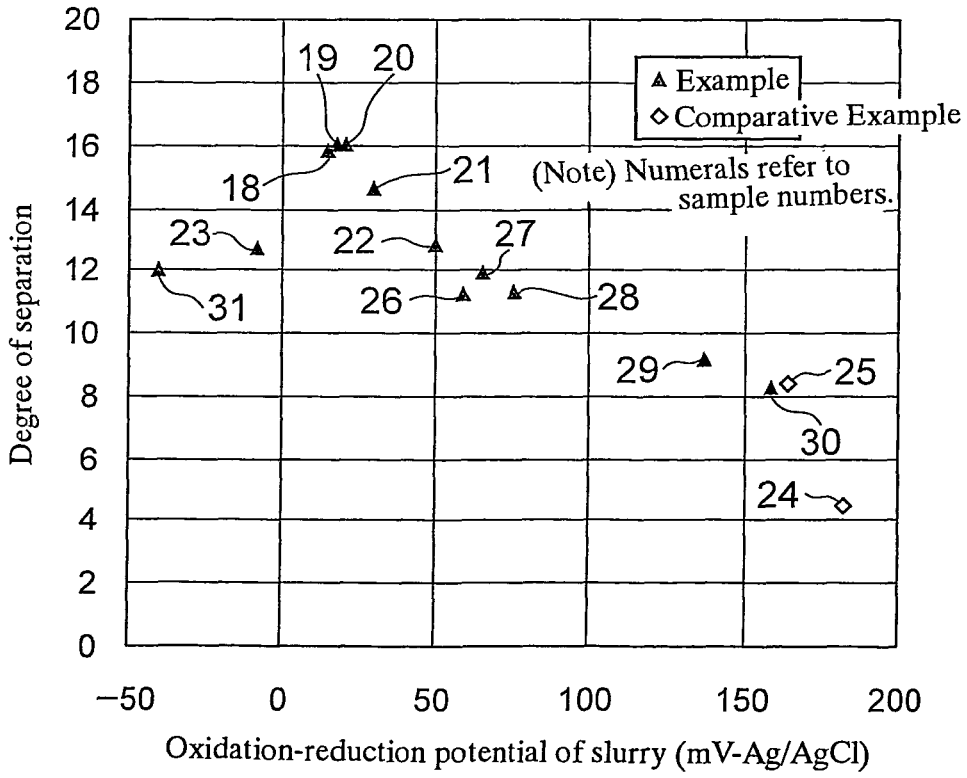
FIG. 4 is a graph showing the relationship between the oxidation-reduction potential of a slurry and the degree of separation determined from the results of Examples 3 to 6.

The copper grade and arsenic grade of the copper concentrate with low arsenic grade and those of the arsenic concentrate were determined for each of Samples 18 to 31. Further, the ratio of distribution of copper to the copper concentrate with low arsenic grade and that to the arsenic concentrate were determined for each of Samples 18 to 31. Similarly, the ratio of distribution of arsenic to the copper concentrate with low arsenic grade and that to the arsenic concentrate were determined for each of Samples 18 to 31. Then, the degree of separation was obtained for each of Samples 18 to 31. The results are shown in the following Table 5. Further, in order to determine the relationship between the oxidation-reduction potential (redox potential) of the slurry and the degree of separation shown in Table 5, the results were plotted to obtain a graph whose horizontal axis represents the oxidation-reduction potential of the slurry and vertical axis represents the degree of separation. The graph is shown in FIG. 4.

TABLE 5

| Sample | Redox potential (mV) | Amount of depressant added (kg/t) | Ratio of distribution of Cu (%) | | Ratio of distribution of As (%) | | Degree of separation |
|---|---|---|---|---|---|---|---|
| | | | Cu concentrate with low As grade | As concentrate | Cu concentrate with low As grade | As concentrate | |
| 18 | 15 | 104 | 84 | 16 | 25 | 75 | 15.8 |
| 19 | 18 | 100 | 80 | 20 | 20 | 80 | 16.0 |
| 20 | 20 | 100 | 81 | 19 | 21 | 79 | 16.0 |
| 21 | 30 | 75.3 | 83 | 17 | 25 | 75 | 14.6 |
| 22 | 49 | 100 | 75 | 25 | 19 | 81 | 12.8 |
| 23 | −8 | 182 | 80 | 20 | 24 | 76 | 12.7 |
| 24* | 182 | 0 | 81 | 19 | 49 | 51 | 4.4 |
| 25* | 163 | 0 | 90 | 10 | 52 | 48 | 8.3 |
| 26 | 59 | 10 | 77 | 23 | 23 | 77 | 11.2 |
| 27 | 65 | 10 | 76 | 24 | 21 | 79 | 11.9 |
| 28 | 75 | 10 | 76 | 24 | 22 | 78 | 11.2 |
| 29 | 136 | 2.5 | 72 | 28 | 22 | 78 | 9.1 |
| 30 | 158 | 0.5 | 77 | 23 | 29 | 71 | 8.2 |
| 31 | −40 | 25 | 88 | 12 | 38 | 62 | 12.0 |

(Note)
Samples of Comparative Examples are marked with the symbol "*".

As can be seen from the results shown in the above Table 5, in the case of Sample 18 obtained by adding sodium thiosulfate so that the oxidation-reduction potential of the slurry was adjusted to 15 mV, 84% of copper contained in the copper concentrate subjected to flotation was distributed to the copper concentrate with low arsenic grade, that is, the ratio of distribution of copper to the arsenic concentrate was as low as 16%. On the other hand, 75% of arsenic contained in the copper concentrate subjected to flotation was distributed to the arsenic concentrate, that is, the ratio of distribution of arsenic to the copper concentrate with low arsenic grade was as low as 25%. As a result, a degree of separation of 15.8 was achieved.

As in the case of Sample 18, in all the cases of Samples 19 to 23 obtained by adjusting the oxidation-reduction potential of the slurry to a value within the range of −8 to 49 mV, the ratio of distribution of copper to the copper concentrate with low arsenic grade was kept at about 80% while the ratio of distribution of arsenic to the copper concentrate with low arsenic grade was kept at low level. From those results, it was confirmed that the effect of sodium thiosulfate on the separation of arsenic minerals was satisfactorily obtained. On the other hand, in the cases of Samples 24 and 25 obtained without adding sodium thiosulfate as a depressant, the oxidation-reduction potential of the slurry was as high as 163 to 182 mV, and the values of degree of separation were 4.4 and 8.3 which were significantly lower than those of Samples 18 to 23.

In the cases of Samples 26 to 30 obtained by adjusting the oxidation-reduction potential of the slurry to a value within the range of 59 to 158 mV, the values of degree of separation were 8.2 to 11.9 which were lower than those of Samples 18 to 23, but the effect of sodium thiosulfate on the separation of arsenic minerals was obtained to some extent. The reason for this can be considered as follows: the effect of sodium thiosulfate cannot be sufficiently obtained when the oxidation-reduction potential of the slurry is higher than 50 mV.

In the case of Sample 31 obtained by adjusting the oxidation-reduction potential of the slurry to −40 mV, the degree of separation was 12.0 which was lower than those of Samples 18 to 23, but the effect of sodium thiosulfate on the separation of arsenic minerals was obtained to some extent. The reason for this can be considered as follows: the effect of sodium thiosulfate on the separation of arsenic minerals is reduced when the oxidation-reduction potential of the slurry is lower than −10 mV.

DESCRIPTION OF REFERENCE NUMERALS

1, 11 grinding step
2, 12 slurry preparation step
3 first flotation step
4 second flotation step
13 flotation step

The invention claimed is:

1. A method for separating an arsenic mineral from a copper-bearing material by flotation, comprising:

adding a flotation agent containing a depressant, a frother, and a collector to a slurry composed of a copper-bearing material containing arsenic; and blowing air into the slurry to float a copper concentrate having a reduced grade of arsenic minerals than the copper-bearing material containing arsenic, wherein the depressant is sodium thiosulfate; and wherein the sodium thiosulfate is added in an amount of 10 kg to 200 kg of sodium thiosulfate pentahydrate per ton of the copper-bearing material to be subjected to the flotation.

2. The method for separating an arsenic mineral from a copper-bearing material according to claim 1, wherein an oxidation-reduction potential of the slurry to be subjected to the flotation, as measured against a silver/silver chloride reference electrode, is adjusted to a value in the range of −10 mV to 50 mV.

3. The method for separating an arsenic mineral from a copper-bearing material according to claim 2, wherein the copper-bearing material is a copper ore.

4. The method for separating an arsenic mineral from a copper-bearing material according to claim 2, wherein the copper-bearing material is a copper concentrate.

5. The method for separating an arsenic mineral from a copper-bearing material according to claim 1, wherein the copper-bearing material is a copper ore.

6. The method for separating an arsenic mineral from a copper-bearing material according to claim 1, wherein the copper-bearing material is a copper concentrate.

7. A method for separating an arsenic mineral from a copper-bearing material by flotation, comprising:

adding a flotation agent containing a depressant, a frother, and a collector to a slurry composed of a copper-bearing material containing arsenic; and blowing air into the slurry to float a copper concentrate having a reduced grade of arsenic minerals than the copper-bearing material containing arsenic, wherein the depressant is sodium thiosulfate; and wherein an oxidation-reduction potential of the slurry to be subjected to the flotation, as measured against a silver/silver chloride reference electrode, is adjusted to a value in the range of −10 mV to 50 mV.

8. The method for separating an arsenic mineral from a copper-bearing material according to claim 7, wherein the copper-bearing material is a copper ore.

9. The method for separating an arsenic mineral from a copper-bearing material according to claim 7, wherein the copper-bearing material is a copper concentrate.

* * * * *